US005799532A

United States Patent [19]

Lewis

[11] Patent Number: 5,799,532

[45] Date of Patent: Sep. 1, 1998

[54] FULLY CONTAINED SELF ADJUSTING NITROGEN BINDER PLATE

[76] Inventor: Ronald O. Lewis, 9535 Daniels Rd., Seville, Ohio 44273

[21] Appl. No.: 651,153

[22] Filed: May 21, 1996

[51] Int. Cl.[6] ..... B21J 13/02

[52] U.S. Cl. ..... 72/446; 72/481.1; 72/481.2; 72/481.3; 100/257

[58] Field of Search ..... 72/446, 481.1, 72/481.2, 481.3, 455, 453.03, 453.13; 100/257, 258 R, 258 A, 295, 918

[56] References Cited

U.S. PATENT DOCUMENTS

| | | | |
|---|---|---|---|
| 1,503,131 | 7/1924 | Nelson . | |
| 1,655,568 | 1/1928 | Rode . | |
| 1,970,134 | 8/1934 | Ferris . | |
| 2,233,164 | 2/1941 | Glasner | 72/455 |
| 2,592,152 | 4/1952 | Johansen | 100/257 |
| 2,938,718 | 5/1960 | Williamson | 267/1 |
| 2,989,019 | 6/1961 | Van Sciver II . | |
| 3,348,406 | 10/1967 | Holberson | 72/446 |
| 3,552,182 | 1/1971 | Handler | 72/453.03 |
| 4,076,103 | 2/1978 | Wallis | 184/25 |
| 4,339,975 | 7/1982 | Carrieri | 83/617 |
| 4,447,047 | 5/1984 | Newell | 267/118 |
| 4,774,865 | 10/1988 | Wallis | 83/128 |
| 4,838,527 | 6/1989 | Holley | 267/119 |
| 4,934,230 | 6/1990 | Wallis | 83/128 |
| 4,951,537 | 8/1990 | Bennett | 83/128 |
| 5,067,340 | 11/1991 | MacGregor | 100/258 R |
| 5,099,673 | 3/1992 | Baur | 72/351 |

FOREIGN PATENT DOCUMENTS

| | | | |
|---|---|---|---|
| 2714958 | 10/1978 | Germany | 72/455 |

*Primary Examiner*—David Jones
*Attorney, Agent, or Firm*—Roger D. Emerson

[57] ABSTRACT

A press for drawing associated raw material is disclosed that includes a die apparatus that has a top portion and a bottom portion, the associated raw material being drawn between the top portion and the bottom portion. The press also includes a stamping apparatus located above the die apparatus for stamping the associated raw material into the die apparatus. The stamping apparatus is movable up and down and exerts a downward force on the associated raw material and the die apparatus. The press also includes a coarse adjusting apparatus for making coarse adjustments to the press and a fine adjusting apparatus for making fine adjustments to position of the top portion of the die apparatus relative to the bottom portion of the die apparatus. The fine adjusting apparatus includes a rectangular binder ring plate located between the stamping apparatus and the top portion of the die apparatus, a plurality of cylinders pressurized with nitrogen and disposed within the binder ring plate, and a plurality of pistons disposed within the cylinder. The pistons are attached to the top portion of the die apparatus. The cylinders and pistons are grouped into control sets and controlled by a controlling apparatus. The press may be produced with the binder ring plate, or a binder ring plate may be retrofitted to an existing press.

17 Claims, 4 Drawing Sheets

FULLY CONTAINED SELF ADJUSTING NITROGEN BINDER PLATE

1. FIELD OF THE INVENTION

This invention pertains to the art of methods and apparatuses for making fine adjustments to die adjustments in large stamping presses, and more specifically to methods and apparatuses for utilizing a binder ring plate with hydraulic pistons filled with nitrogen gas to make fine press adjustments.

2. DESCRIPTION OF THE RELATED ART

Large stamping presses typically feature a large stamping mechanism that forces a top part of a die to contact a bottom part of the die, with a material to be drawn placed in between. The present invention is specially adapted for use in double action, draw presses. Typical presses of that type were originally manufactured by the Clearing Company, and are presently available through Hitachi Zozen. In such presses, typically a die is mounted on a bottom bolster bed while a second, top half of the die is mounted to the outer ram. Typically, the outer ram is hollow so that the punch can travel downwardly through its center. The present invention is mounted to the outer ram of the press.

In the past, adjustment of the two parts of the die was made by rotating large adjusting nuts in the stamping mechanism that, in turn, altered the position of the top part of the die with respect to the bottom part of the die. The adjustments to the adjusting nuts would often take a large amount of time, up to approximately two hours. The large amount of time taken to adjust the press for die changes often limited the productivity of the stamping press, since dies are typically changed at least once a day.

Past stamping presses have utilized hydraulic pistons to cushion the die in a stamping press from the blow of the punch. However, the hydraulic pistons have never been utilized to make fine die adjustments. Applicant recognized that pistons filled with nitrogen gas could make rigid adjustments in large stamping presses. Applicant further recognized the problems with current methods of making press adjustments.

The present invention contemplates a new and improved apparatus and method for making press adjustments which is simple in design, effective in use, and overcomes the foregoing difficulties and others while providing better and more advantageous overall results.

SUMMARY OF THE INVENTION

In accordance with the present invention, a new and improved method and apparatus for making fine press adjustments is provided which utilizes a binder ring plate containing nitrogen pistons to adjust the die adjustment.

More particularly, in accordance with the present invention a press for drawing associated raw material includes a die apparatus for drawing the associated raw material into an associated product. The die apparatus has a top portion and a bottom portion. The associated raw material is drawn between the top portion and the bottom portion. The press also includes a stamping apparatus for stamping the associated raw materials into the die apparatus. The stamping apparatus is located above the die apparatus and is movable upwardly and downwardly. The stamping apparatus exerts a downward force on the associated raw material and the die apparatus. The top portion of the die apparatus is attached to the stamping apparatus. The press further includes a coarse adjusting apparatus for making coarse adjustments to the die apparatus and the stamping apparatus and a fine adjusting apparatus for making fine adjustments to the position of the top portion of the die apparatus relative to the bottom portion of the die apparatus, thereby aligning the die apparatus.

According to one aspect of the present invention, the adjusting apparatus includes a binder ring plate located between the stamping apparatus or outer ram and the top portion of the die apparatus. The binder ring plate includes a cylinder disposed within the binder ring plate and a piston disposed within the cylinder. The binder ring plate is attached to the top portion of the die apparatus.

According to another aspect of the present invention, a press adjustment apparatus is to be retrofitted to a press for drawing an associated material that includes a stamping apparatus for stamping the associated material, a die apparatus for drawing the associated material, and a coarse adjustment apparatus for making coarse adjustments to position of the die apparatus. The press adjustment apparatus includes a fine adjusting apparatus for making fine adjustments to the position of a top portion of the die apparatus relative to a bottom portion of the die apparatus, thereby aligning the top portion and the bottom portion of the die apparatus. The press adjustment apparatus also includes a retrofitting apparatus for retrofitting the fine adjusting apparatus to the press.

According to another aspect of the present invention, a method of adjusting a press for drawing an associated material includes the step of stamping the associated material between the top portion and the bottom portion of the first die apparatus to die an associated product. The method further includes the steps of removing the first die apparatus from the press and installing the second die apparatus into the press. The press is then adjusted so the top portion of the second die apparatus abuts the bottom portion of the second die apparatus when the stamping apparatus stamps the associated material between the top and bottom portions of the second die apparatus.

One advantage of the present invention is its ability to reduce the time required to make fine adjustments to the press.

Another advantage of the present invention is that the fine press adjustments may be made without having to enter the press, thereby increasing safety.

Another advantage of the present invention is that fine adjustments may be made to the press by activating nitrogen filled cylinders and pistons.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
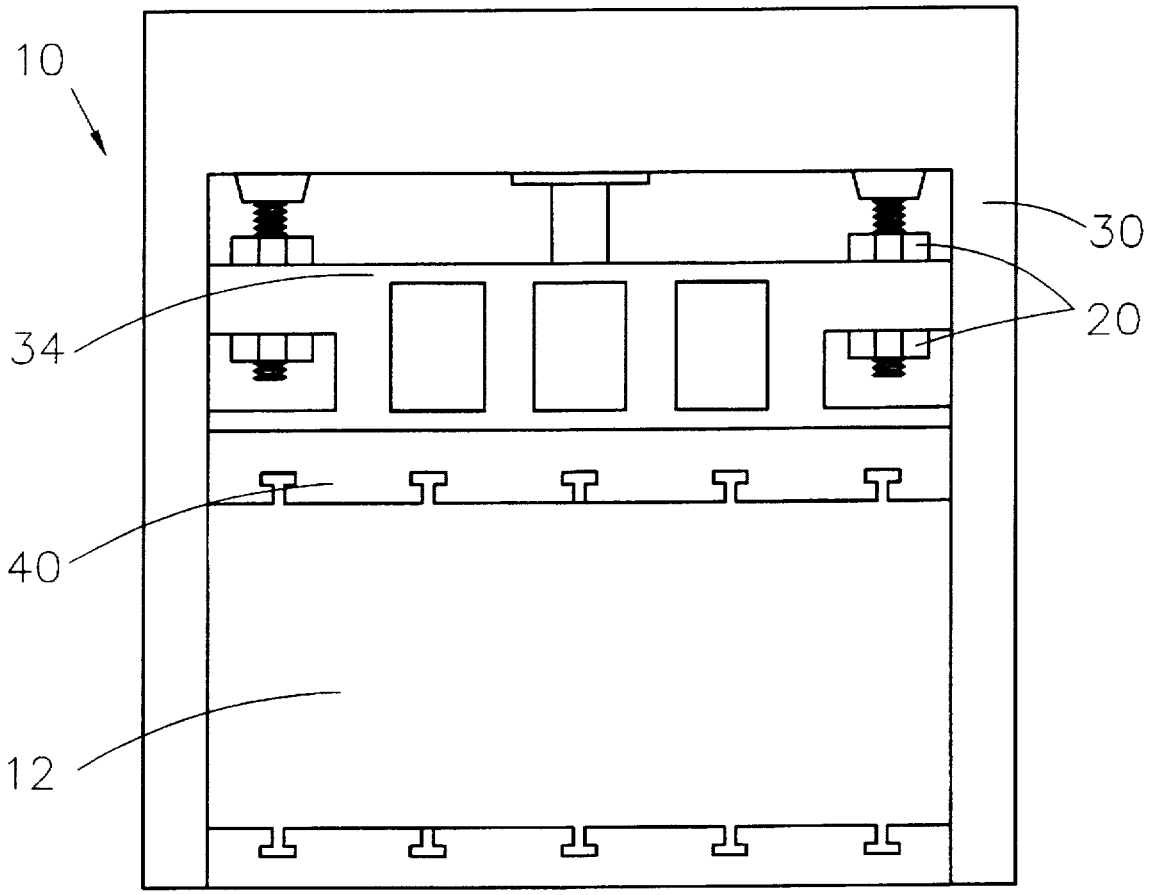
FIG. 1 is a perspective view of a large stamping press.

Referring now to the drawings wherein the showings are for purposes of illustrating a preferred embodiment of the invention only and not for purposes of limiting the same, FIG. 1 shows a perspective view of a large stamping press 10. A die (not shown) is to be placed in the optive area 12 to stamp or draw material into a finished product. The height of the die may be compensated for by adjusting the coarse adjustment apparatus by turning the adjusting nuts 20 at each corner of the stamping press 10. Typically, the adjusting nuts 20 are threaded so that one revolution moves the outer rim 30 of the stamping apparatus 34 a distance of one quarter inch. For example, if a first die is removed from the optive area 12 and replaced with a second die, and the second die is three inches taller than the first die, then the adjusting nuts 20 may be rotated 12 revolutions to accommodate the three inch differential.

Figure 2:
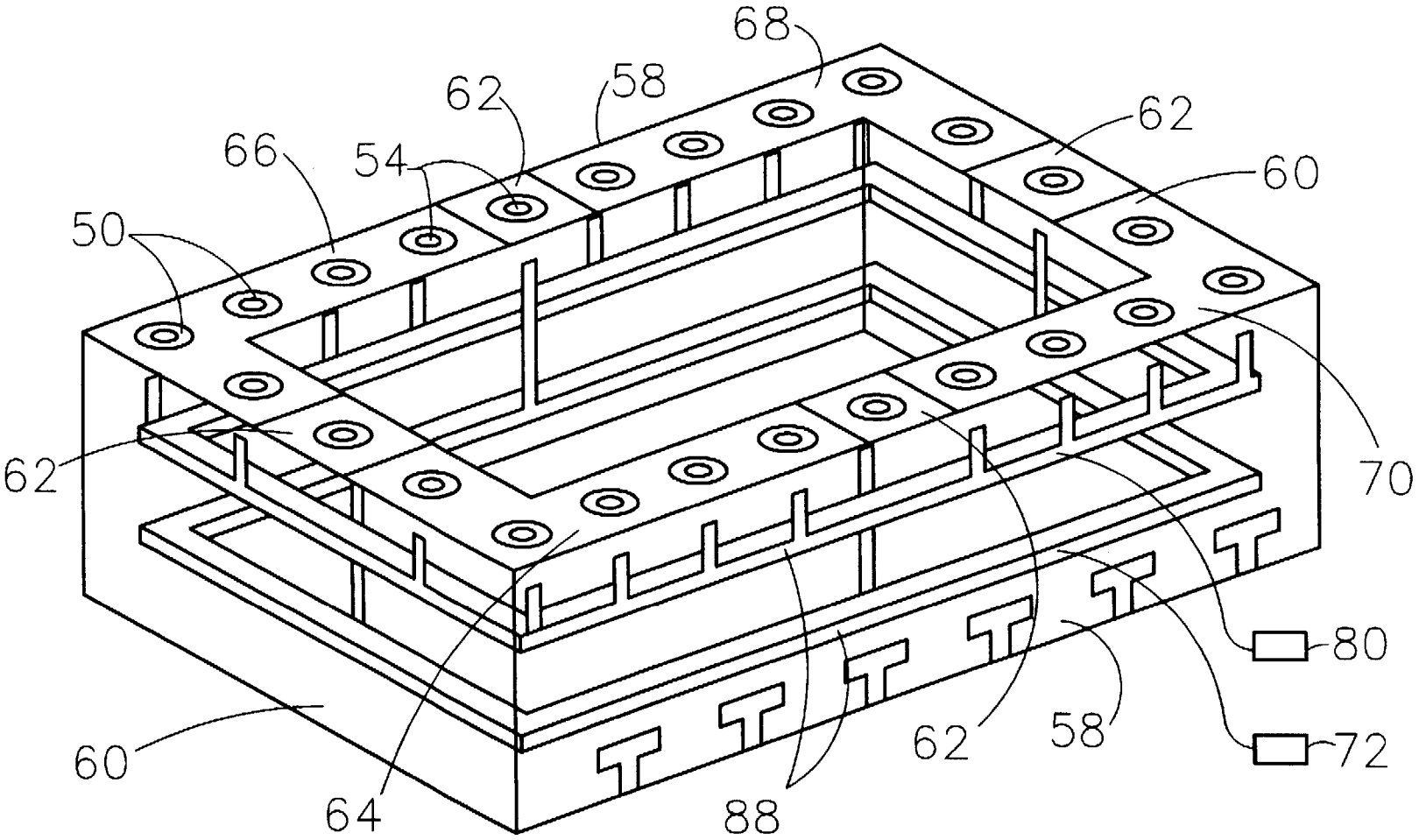
FIG. 2 is a perspective view of a nitrogen binder ring plate.

With references to FIGS. 1 and 2, fine adjustments may also be made to accommodate for differences in the height of a die by adjusting the binder ring plate 40. The binder ring plate 40 is located between the stamping apparatus 34 and the optive area 12 and is preferably rectangular or square in shape. The binder ring plate contains a number of cylinders 50 and pistons 54. In the preferred embodiment, the binder ring plate 40 is rectangular in shape and contains twenty-four cylinders 50 and twenty-four pistons 54. The binder ring plate 40 preferably has two long sides 58 that contain seven cylinders 50 and seven pistons 54 each, and two short sides 60 that contain five cylinders 50 and five pistons 54 each. The number of cylinders 50 and pistons 54 may vary depending on the size of the stamping press 10. The cylinders 50 operate with nitrogen. In the preferred embodiment, the cylinders 50 and pistons 54 are configured into five control sets. The master control set 62 contains four of the cylinders 50 and four of the pistons 54, one cylinder and one piston in the center of each of the four sides of the binder ring plate 40. A first corner control set 64 contains the three adjacent cylinders 50 and pistons 54 from one of the long sides 58 and the two adjacent cylinders 50 and pistons 54 from one of the short sides 60. A second corner control set 66, a third corner control set 68, and a fourth corner control set 70 each contain the same arrangement as the first corner control set 64, each in a different corner of the binder ring plate 40. All of the control sets 62, 64, 66, 68, and 70 are preferably tied to a single control module 80 which can independently monitor and control the nitrogen pressure in each of the control sets. Small adjustments to accommodate inaccuracies in the die can be made by controlling the nitrogen gas pressure in any one of the five control sets 62, 64, 66, 68, or 70. For example, the nitrogen pressure in the first corner control 64 set may be increased above or decreased below the pressure in the remaining control sets 62, 66, 68, and 70 to correct for inaccuracies in the die at the corner of the die adjacent the first corner control set 64. The nitrogen gas pressure is controlled throughout the binder ring plate 40 by a binder ring plate system 88 which is connected to the control module 80. In the preferred embodiment of the invention, an independent second control module 92 is supplied to control the master control set 62.

Figure 3:
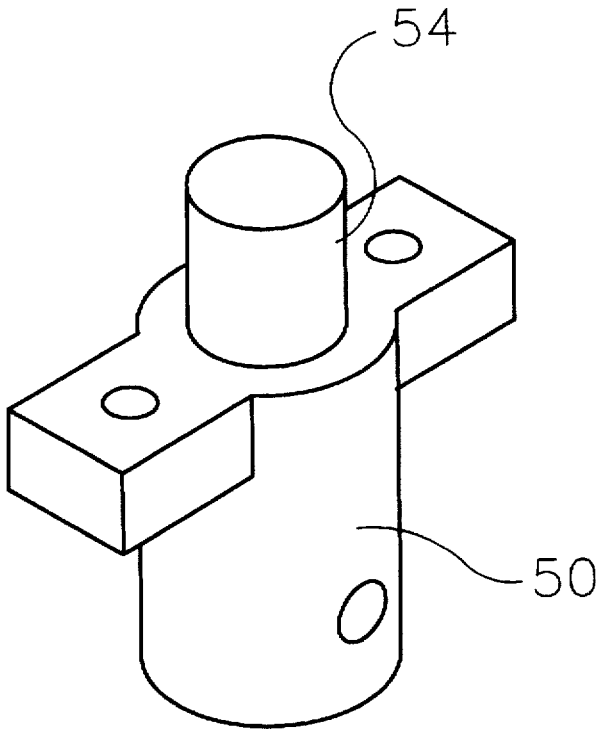
FIG. 3 is a detailed view of a cylinder and piston.

The primary advantage of the binder ring plate 40 is that small inaccuracies in the die can be accommodated by adjusting the location of the binder ring plate 40 using the nitrogen cylinders 50 and pistons 54. FIG. 3 shows a detailed view of one of the cylinders 50 and one of the pistons 54. The nitrogen cylinders 50 and pistons 54 may make adjustments as fine as one half inch, which is the length of a stroke of the pistons 54. The press 10 may typically be adjusted in about thirty minutes by using the nitrogen binder ring plate 40. Additionally, workers do not have to enter the press 10 to make adjustments, but simply make the adjustments by operating the control modules 80, 92 to control the control sets 62, 64, 66, 68, and 70.

The stamping press 10 may be produced with a nitrogen binder ring plate 40 in place, or a nitrogen binder ring plate 40 may be retrofitted to an existing stamping press 10. The binder ring plate 40 may be retrofitted to the press 10 by adjusting the adjusting nuts 20 so that the stamping apparatus 34 is raised high enough so that the binder ring plate 40 may be fitted between the stamping apparatus 34 and the die.

Figure 4:
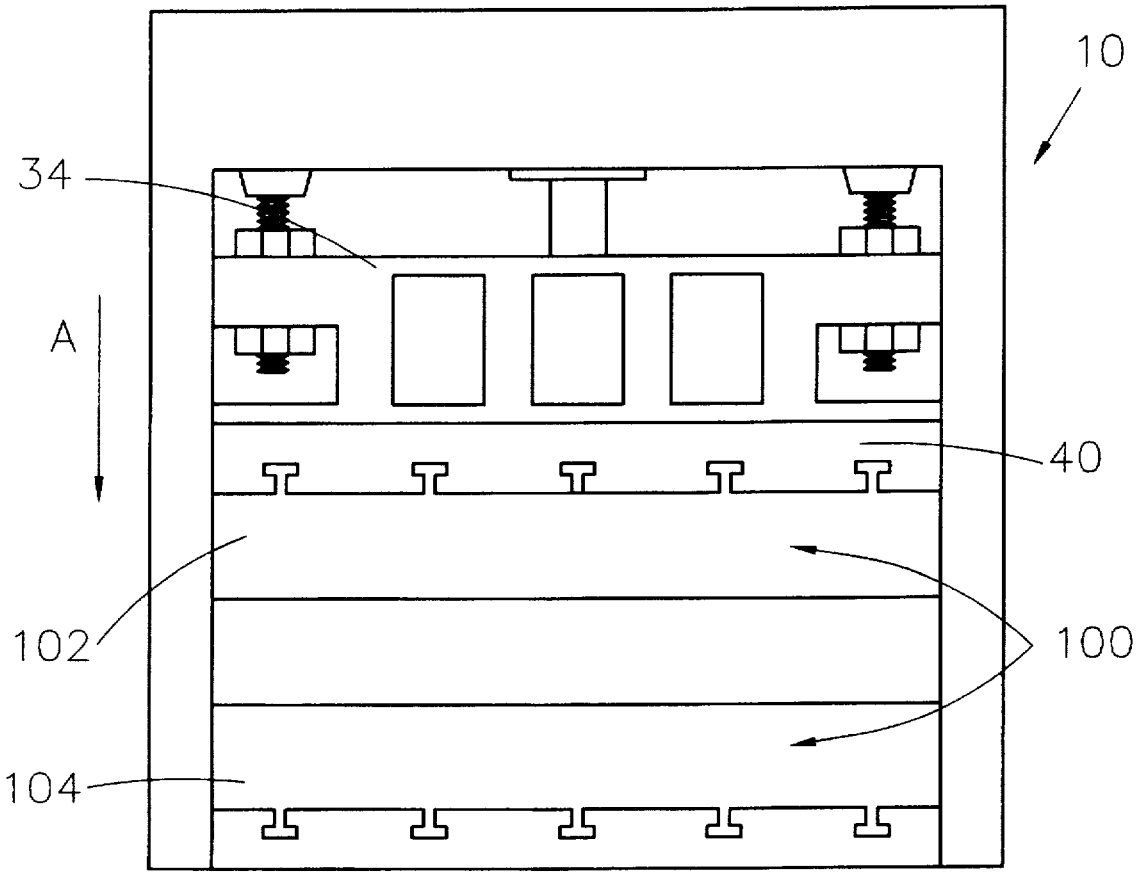
FIG. 4 is a perspective view of a large stamping press with a die apparatus installed.

FIG. 4 shows a stamping press 10 with a forming apparatus such as a die 100 installed. The binder ring plate 40 is placed between the stamping apparatus 34 and the top portion 102 of the die 100. The stamping apparatus 34 forces the binder ring plate 40 and top portion 102 of the die 100 downward in the direction of arrow A until the top portion 102 contacts the bottom portion 104 of the die 100. The associated material placed between the two portions 102, 104 of the die 100 is then stamped or formed into the shape prescribed by the die 100.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A press for drawing an associated raw material, said press comprising:

die means for drawing said associated raw material into an associated product, said die means having a top portion and a bottom portion, said associated raw material being drawn between said top portion and said bottom portion;

stamping means for stamping said associated raw material into said die means, said stamping means being located above said die means, said stamping means being movable up and down, said stamping means exerting a downward force on said associated raw material and said die means, said top portion of said die means being attached to said stamping means;

fine adjusting means, said die adjusting means having a binder ring plate, said binder ring plate being located between said stamping means and said top portion of said die means, said binder ring plate having a plurality of cylinders and pistons, said plurality of cylinders being disposed within said binder ring plate, said plurality of pistons being disposed within said plurality of cylinders and being attached to said top portion of said die means, said plurality of cylinders and pistons are pressurized by nitrogen gas, and wherein said fine adjustment means is for making fine adjustments to position of said top portion of said die means relative to said bottom portion of said die means, thereby aligning said die means; and a control module for controlling said plurality of cylinders and said plurality of pistons.

2. The press of claim 1 wherein said press further comprises:

a coarse adjusting means for making coarse adjustments to said die means and said stamping means.

3. The press of claim 2 wherein said coarse adjusting means comprises nuts and bolts, one rotation of said nuts adjusting said die means one quarter inch.

4. A press for drawing an associated raw material, said press comprising:

die means for drawing said associated raw material into an associated product, said die means having a top portion and a bottom portion, said associated raw material being drawn between said top portion and said bottom portion;

stamping means for stamping said associated raw material into said die means, said stamping means being located above said die means, said stamping means being movable up and down, said stamping means exerting a downward force on said associated raw material and said die means, said top portion of said die means being attached to said stamping means;

coarse adjusting means for making coarse adjustments to said die means and said stamping means; and, fine adjusting means for making fine adjustments to position of said top portion of said die means relative to said bottom portion of said die means, thereby aligning said die means, said die adjusting means comprising a binder ring plate, said binder ring plate being located between said stamping means and said top portion of said die means, said binder ring plate substantially rectangular in shape, said binder ring plate having two long sides and two short sides, said binder ring plate containing a plurality of cylinders and a plurality of pistons, said plurality of cylinders being disposed within said binder ring plate, and said plurality of pistons being disposed within said cylinder and being attached to said top portion of said die means; and wherein said plurality of cylinders and said plurality of pistons are pressurized by nitrogen gas and are grouped into a plurality of control sets, said control sets being controlled by controlling means for controlling said cylinders and said pistons.

5. The press of claim 4 wherein said binder ring plate contains twenty-four cylinders and twenty-four pistons and said twenty-four cylinders and twenty-four pistons are grouped into five control sets, said five control sets being controlled by controlling means for controlling said cylinders and said pistons.

6. The press of claim 5 wherein said five control sets comprise:

a master control set, said master control set having one cylinder and one piston in the center of each long side and short side of said binder ring plate; and, four corner control sets, said corner control sets each having five adjacent pistons located between said pistons of said master control set, each of said four corner control sets containing three pistons from one of said long sides and two pistons from one of said short sides.

7. The press of claim 6 further comprising a control module, said control module controlling said master control set and said four corner control sets.

8. The press of claim 6 further comprising:

a first control module, said first control module controlling said master control set; and, a second control module, said second control module controlling said four corner control sets.

9. A press adjustment apparatus to be retrofitted to a press for drawing an associated material, said press comprising stamping means for stamping said associated material, die means for drawing said associated material, and coarse adjustment means for making coarse adjustments to position of said die means, said press adjustment apparatus comprising:

fine adjusting means for making fine adjustments to position of a top portion of said die means relative to a bottom portion of said die means, thereby aligning said top portion and said bottom portion of said die means, said press adjusting means comprising a binder ring plate, said binder ring plate being located between said stamping means and said top portion of said die means, a cylinder, said cylinder being disposed within said binder ring plate, and a piston, said piston being disposed within said cylinder, said piston being attached to said top portion of said die means, said cylinder and piston is pressurized with nitrogen gas; and, retrofitting means for retrofitting said fine adjusting means to said press.

10. A press adjustment apparatus to be retrofitted to a press for drawing an associated material, said press comprising stamping means for stamping said associated material, die means for drawing said associated material, and coarse adjustment means for making coarse adjustments to position of said die means, said press adjustment apparatus comprising:

fine adjusting means for making fine adjustments to position of a top portion of said die means relative to a bottom portion of said die means, thereby aligning said top portion and said bottom portion of said die means, said fine adjusting means having a binder ring plate, said binder ring plate being located between said stamping means and said top portion of said die means, said binder ring plate containing twenty-four cylinders and twenty-four pistons, said cylinders being disposed within said binder ring plate, said pistons being disposed within said cylinder and attached to said top portion of said die means, retrofitting means for retrofitting said die adjusting means to said press; and wherein said twenty-four cylinders and said twenty-four pistons are individually controlled by controlling means for controlling said cylinders and said pistons and grouped into five control sets, said control sets being controlled by controlling means for controlling said cylinders and said pistons.

11. The press of claim 10 wherein said cylinder and piston is pressurized with nitrogen gas.

12. The press of claim 10 wherein said five control sets comprise:

a master control set, said master control set having one cylinder and one piston in the center of each long side and short side of said binder ring plate; and, four corner control sets, said corner control sets each having five adjacent cylinders and pistons located between said cylinders and said pistons of said master control set, each of said four corner control sets containing three cylinders and three pistons from one of said long sides and two cylinders and two pistons from one of said short sides.

13. The press of claim 12 further comprising a control module, said control module controlling said master control set and said four corner control sets.

14. The press of claim 12 further comprising:

a first control module, said first control module controlling said master control set; and, a second control module, said second control module controlling said four corner control sets.

15. A method of aligning and adjusting a press for drawing an associated material, said press comprising stamping means for stamping said associated material, first and second die means for drawing said associated material, each of said die means having a top portion and a bottom portion, coarse adjustment means for making coarse adjustments to said first and second die means and said stamping means, and fine adjustment means for making fine adjustments to said press, said fine adjustment means comprising a plurality of pistons and cylinders pressurized by nitrogen gas, said plurality of pistons being disposed within said cylinder, said method comprising the steps of:

stamping said associated material between said top portion and said bottom portion of said first die means to die a product;

removing said first die means from said press;

installing said second die means into said press;

adjusting said top portion of said second die means to abut said bottom portion of said second die means when said stamping means stamps said associated material between said top and bottom portions of said second die means; and activating said pistons to adjust said top portion of said second die means relative to said bottom portion of said second die means by increasing or decreasing the pressure within said pistons and cylinders, said pistons being controlled by said controlling means.

16. A press for drawing an associated raw material, said press comprising:

die means for drawing said associated raw material into an associated product, said die means having a top portion and a bottom portion, said associated raw material being drawn between said top portion and said bottom portion;

stamping means for stamping said associated raw material into said die means, said stamping means being located above said die means, said stamping means being movable up and down, said stamping means exerting a downward force on said associated raw material and said die means, said top portion of said die means being attached to said stamping means;

fine adjusting means comprising a plurality of cylinders and pistons, said plurality of pistons being disposed within said plurality of cylinders and being attached to said top portion of said die means, said plurality of cylinders and pistons pressurized by nitrogen gas, and wherein said fine adjustment means is able to make fine adjustments to position of said top portion of said die means relative to said bottom portion of said die means, thereby aligning said die means.

17. The press of claim 16 wherein said fine adjusting means further comprises a control module for controlling said plurality of pistons and cylinders.

* * * * *